United States Patent [19]

Sledge et al.

[11] Patent Number: 4,852,770

[45] Date of Patent: Aug. 1, 1989

[54] CHILD-RESISTANT DISPENSING CLOSURE

[75] Inventors: Larry C. Sledge, Midlothian, Va.; Gordon J. Filipczak, Edina, Minn.

[73] Assignee: Specialty Packaging Licensing Co., Wilmington, Del.

[21] Appl. No.: 140,157

[22] Filed: Dec. 31, 1987

[51] Int. Cl.[4] ..... B67B 5/00

[52] U.S. Cl. ..... 222/153; 222/546; 215/216

[58] Field of Search ..... 222/153, 543, 546, 554; 215/216, 214, 217, 218, 224; 220/306, 375, 254; 292/DIG. 11; 24/617, 658

[56] References Cited

U.S. PATENT DOCUMENTS

| | | | |
|---|---|---|---|
| Re. 30,861 | 2/1982 | Krawagna | 16/293 |
| 3,289,877 | 12/1966 | Wolf | 220/31 |
| 3,623,622 | 11/1971 | Sullivan | 222/543 |
| 3,744,675 | 7/1973 | Song | 222/153 |
| 4,127,221 | 11/1978 | Vere | 222/153 |
| 4,158,902 | 6/1979 | Cherwack et al. | 16/150 |
| 4,244,495 | 1/1981 | Lorscheid et al. | 222/153 |
| 4,310,102 | 1/1982 | Walter | 222/153 |
| 4,386,714 | 6/1983 | Roberto et al. | 220/339 |
| 4,414,705 | 11/1983 | Ostrowsky | 16/225 |
| 4,487,324 | 12/1984 | Ostrowsky | 215/253 |

FOREIGN PATENT DOCUMENTS 1082983 9/1967 United Kingdom .

*Primary Examiner*—Joseph J. Rolla
*Assistant Examiner*—Kenneth Noland
*Attorney, Agent, or Firm*—Dallett Hoopes

[57] ABSTRACT

This invention relates to a child-resistant dispensing closure for fitment to a container. The closure has a base portion and a cap portion hingedly connected thereto. This child-resistant features includes an elongated, flexible, resilient post which extends upwardly from the base and which has an enlarged upper end. When the cap is brought to the closed position, the elongated upper end passes through an aperture in the cap top wall and assumes a position which interferes with the opening of the cap.

29 Claims, 6 Drawing Sheets

CHILD-RESISTANT DISPENSING CLOSURE

BACKGROUND OF THE INVENTION

This invention relates to a child-resistant closure for fitment to a container.

The use of child-resistant closures in the packaging of toxic materials, e.g., bleach, liquids containing petroleum distillates, drain cleaners, etc., is well known. Generally, the closures depend upon a releasable, locking relationship between the closure and the container or, for those closures having a base portion attached to the container, between the base portion and an opening and closing cap portion. The most commercially successful closures are those which are designed to stymie the opening efforts of a child, but not frustrate the opening efforts of an adult, especially the elderly, arthritic, etc. A child-resistant closure which is claimed to accomplish such a dual mission is the closure described in U.S. Pat. Ser. No. 4,127,221. This closure features a base portion and a cap portion which is hingedly attached to the base portion. The base portion is fitted to a container and has a top wall with a dispensing orifice. The top wall also carries an upstanding lever member which is flexible and resilient. The lever member has a pawl-shaped end. The cap portion of the closure has a top wall with an opening through which the pawl-shaped end passes when the cap is brought to the closed position. The alignment of the pawl-shaped lever with the cap's top portion is achieved by the configuration of the top of the pawl-shaped lever which acts to distort or bend the pawl-shaped lever and guide it through an opening during the closing cycle. The location of this closing feature (on the pawl-shaped lever) is critical to this closure, allowing the pawl-shaped lever to pass through the cap's top. So passed, the pawl-shaped end achieves a releasable lock between the cap portion and the base portion by overlying that portion of the top wall which is on the edge of the opening. It is critical to the maintenance of the child-resistant feature of this closure that, when the closure is closed, the locations of the opening and the lever member are such that the resilient properties of the lever member will continuously urge the pawl-shaped end against the front edge of the opening, thereby maintaining the overlying position mentioned above. If there is a loss in the lever member's resiliency, the required urging is diminished and the child-resistant feature of this closure could be compromised. Loss in resiliency is not uncommon for a lever member made of a thermoplastic material, especially if the lever member is held under stress over a long period of time. Since many products have a shelf life of months, if not years, the use of this type of closure as a packaging component is not always advisable.

Therefore, it is an object of this invention to provide a closure which has a child-resistant releasable locking system, which system is not adversely affected during the shelf life of a wide variety of products, even if the shelf life is for several years.

The Invention

This invention relates to a child-resistant closure for fitment to a container. The closure has a base and a cap hingedly connected to the base so that the cap may move between an open position and a closed position. The base has an annular base side wall which has at one of its ends a base top wall. To attach the closure to the container, the base has attaching structure. The attaching structure can be a helical thread about the inside of the base side wall, which thread cooperates with a helical thread about the neck of the container. To prevent defeat of the child-resistant quality of the subject closure by merely unthreading the closure from the container, it is preferred that the closure and the container have cooperating structure which prevents the unthreading of the closure from the container. Such structure is well known to those skilled in the art and can, for example, comprise ratcheting locking lugs on the container and closure which allow for threading the closure onto the container, but resist unthreading of the closure from the container. The attaching structure need not be cooperating helical threads but instead can comprise a snap-on system which features a bead and a groove, one of which is located on the container and the other of which is located on the closure.

In some applications, it may be desirable to fit the subject closure to the container so that the closure can be selectively removed from the container by an adult but not easily by a child. For such applications, the container can carry an annular flange about the container neck, which flange is made discontinuous by a gap therein. The closure, in this case, has a lug extending radially inward from the base side wall. The lug is dimensioned so that it obtains a snap fit under the flange but can be passed through the gap when the lug is in registry with the gap. Once the lug and flange gap are brought into registry, the interference of the lug underlying the flange is lost and the closure can be removed from its fit to the container. With this type of system, the fit is usually augmented by secondary lugs which also underlie the flange to provide an area of secondary interference. This secondary interference is easily defeated once the lug and gap are brought into registry by visual alignment of indicators, one on the closure and one on the mating bottle. These can take various shapes but generally are similar one to the other. A removal force is applied to the closure to remove it from the container.

The base top wall has a dispensing orifice therethrough so that the contents of the container, usually a liquid or gel, can be dispensed. Projecting upwardly from the top wall is an elongated, flexible, resilient post. The post has an enlarged upper end.

The cap, which is hingedly connected to the base, features a cap top wall having a locking aperture therein. The aperture has a first portion and a second portion. The first portion allows for free passage therethrough of the enlarged upper end of the post when the post is deflected to a position so that the enlarged upper end is in alignment with the first portion. This alignment occurs when the cap is brought to the closed position and when it is unlocked for opening. The second portion, when the cap is in the closed position, allows the post to resiliently return to its predeflection position whereby at least a portion of the post below the enlarged upper end is within the second portion. The second portion is dimensioned so that the enlarged upper end cannot pass therethrough, thereby placing the enlarged upper end in a position of interference with a portion of the upper surface of the cap top wall when the cap is in the closed position.

In a preferred form, the locking aperture is T-shaped with the first portion being the crossing portion of the T and the second portion being the crossed portion of the T. The second portion has its long axis substantially along the path which the post travels between its deflected position and its predeflection position.

To facilitate deflection of the post during closing of the cap, the cap preferably has deflecting means for contacting the enlarged upper end of the post and using the closing movement of the cap to achieve deflection of the post and the alignment of the enlarged upper end with the first portion of the locking structure.

It is also preferred that the cap have plugging structure for plugging the dispensing orifice when the cap is in the closed position. The plugging of the dispensing orifice is generally a requirement for closures which are to be utilized commercially as the package must prevent undesirable leaking during shipping and storage even if the package is in the inverted position.

In the closure of this invention, the orifice plug is constructed so as to not present a collecting reservoir for product that may become airborne during the opening action. Some prior art closures use a hollow orifice plug with the open end facing the product. As product collects in the "hollow" during shipping, it cannot run back into the container. The closure of this invention is constructed to minimize product collecting on the orifice plug. The closure's orifice plug presents a solid surface to the product. It also is radiused to form a meniscus should product attempt to collect on its radiused orifice plug. This meniscus of product and related surface tension should have the force to resist pulling of product through the dispensing orifice during an opening action.

It is preferred, from a cost standpoint and from a suitability-of-materials standpoint, that the child-resistant dispensing closure of this invention be of a thermoplastic material, such as polyethylene, polypropylene, polyethylene terephthalate, nylon, etc. When the closure is of a thermoplastic material, it can be conveniently formed by well known injection molding techniques. The closure can be integrally formed as a one-piece closure or can be comprised of multiple pieces, such as a two-piece closure, depending upon engineering requirements demanded by the molding process and the particular closure configuration chosen.

For the purpose of this invention, a one-piece closure is a closure in which all closure parts are integrally formed. One-piece closures can be of the linerless type or can be of the type with which a liner is used. In the latter case, the liner is not considered as a part of the closure, but rather as a part of a closure system. A multiple piece closure is a closure in which is comprised of multiple pieces which are combined to form the complete closure. This type of closure can also be linerless or can be used with a liner, which liner is, again, part of a closure system and not considered as a part of the closure.

In use, the child-resistant dispensing closure of this invention is the paragon of simplicity and should not frustrate the opening attempts by the elderly or infirm. It is a special feature of the subject closure that its child-resistance depends more upon a mental understanding of the opening steps rather than solely upon a releasable locking structure which is too physically difficult for a child to operate.

Operation of the subject closure is described by the following. With the cap top wall in the open position, the contents of the container may be dispensed through the dispensing orifice found in the base top wall. After the product has been dispensed, the cap top wall is simply moved towards the closed position. As the cap top wall is moved towards the closed position, the post, which is found on the base top wall, can be manually deflected or be deflected by deflecting structure found on the cap top wall so that the enlarged upper end of the post is brought into alignment with the first portion of the locking aperture. During deflection, the post is placed under stress. As the cap top wall is brought to the final closed position, and as the enlarged upper end of the post overlies the top surface of the cap top wall, the resilient nature of the post will bring that portion of the post just below the enlarged upper end to a point of rest within the second portion of the locking aperture. At this point, the post is free of stress and is not required to urge, through its resiliency, the enlarged upper end to any particular engagement with the cap top wall. By the second portion being dimensioned so as to not allow the enlarged upper end to pass therethrough, any attempt to bring the cap top wall to the open position is prohibited by the interference of the enlarged upper end of the post, in its overlying position, with that portion of the cap top wall which is adjacent the second portion of the locking aperture. To move the cap top wall to the open position, the user merely has to deflect the post by applying a force to the enlarged upper end so that the enlarged upper end is in alignment with the first portion of the locking aperture. With this alignment achieved, the cap top wall can be opened by an upward force applied to the cap top, which force is generally applied opposite the hinge. In a preferred embodiment, the force is applied to a lift-up tab which is substantially 180° about the closure circumference from the hinge area. Although 180° is convenient to most adults, it is also easier for children to operate. Accordingly, another preferred embodiment has similar lift-up tabs at areas ranging from 90°, 135° or 165°about the closure circumference from the hinge. As a further feature, the lift-up-tab can be either placed on the closure singly or in pairs for either right or left handed users.

These and other features of this invention contributing to satisfaction in use and economy in manufacture will be more fully understood from the following description of the preferred embodiments of this invention and the accompanying drawings in which.

Figure 1:
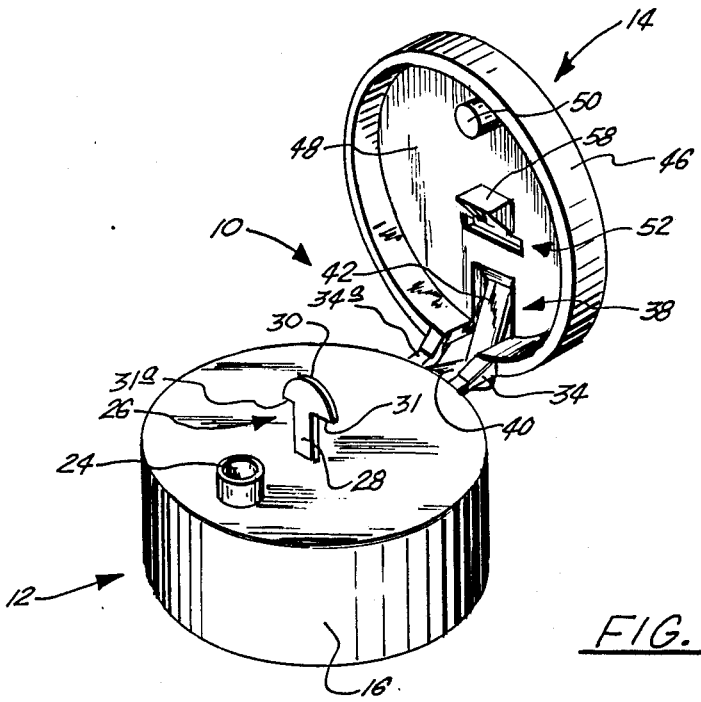
FIG. 1 is a perspective view of a one-piece closure of this invention.
Figure 7:
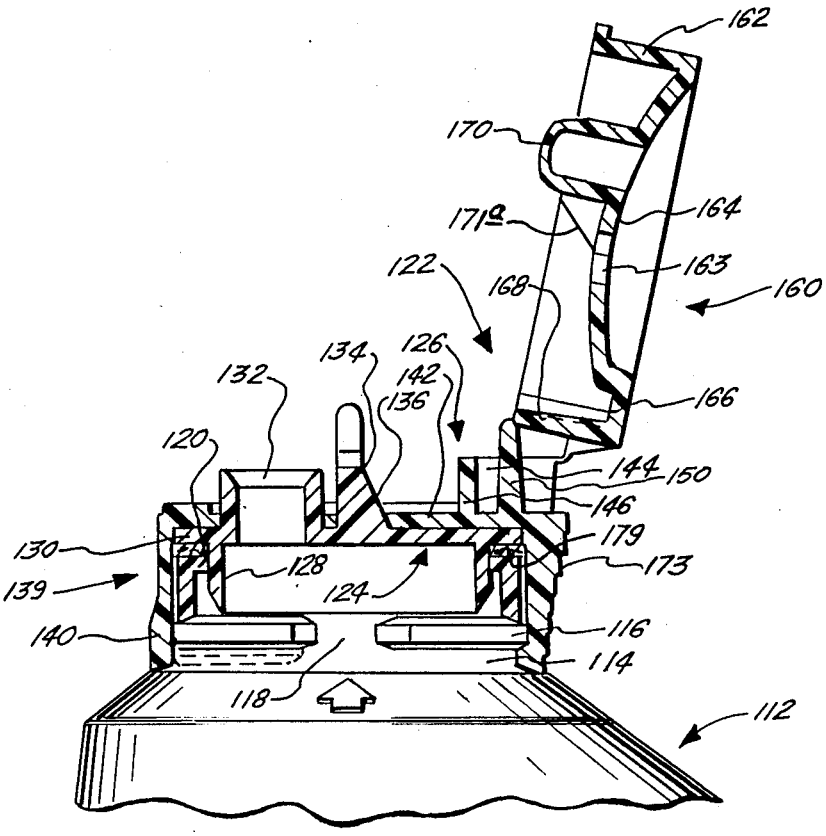

FIGS. *6a*, *6b* and *6c* are enlarged views showing the post and locking aperture shown in FIG. 1;

FIG. 7 is a partial vertical sectional view of a two-piece closure of this invention fitted to a container neck.

Figure 8:
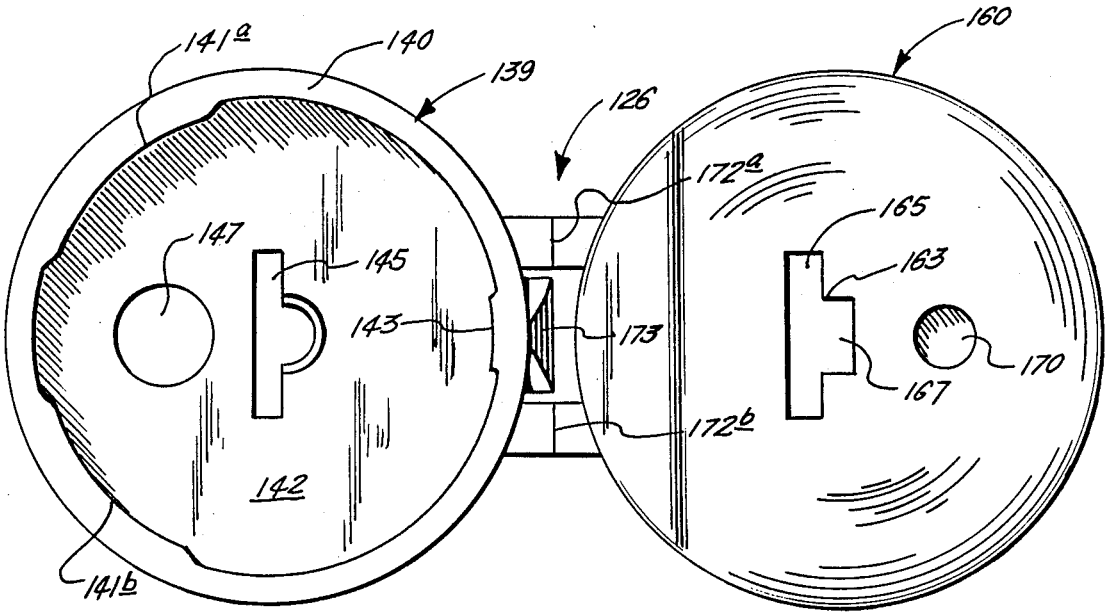
Figure 9:
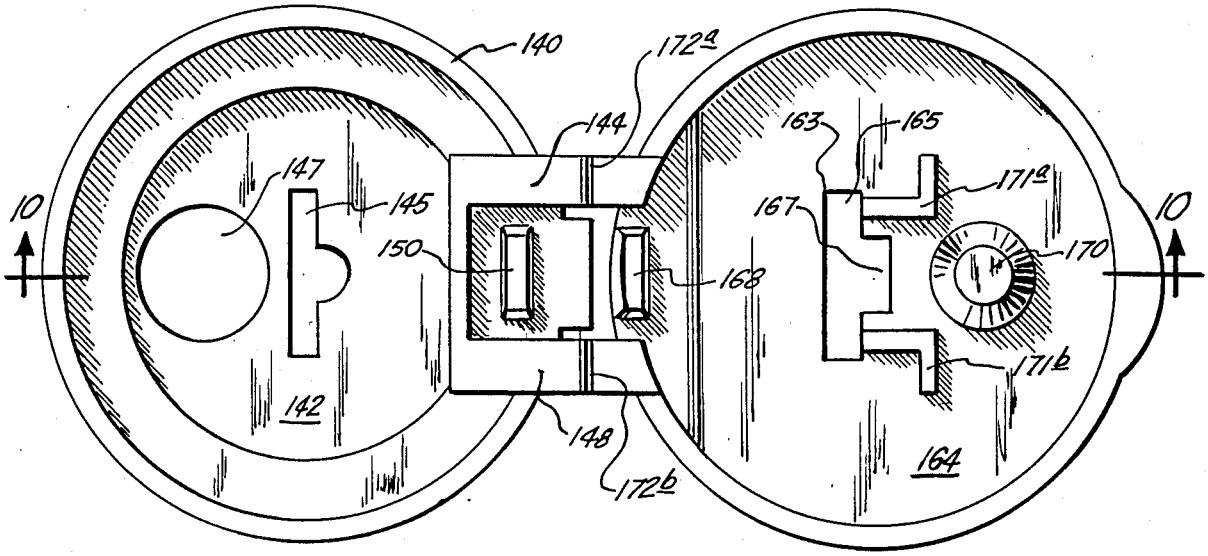
Figure 10:
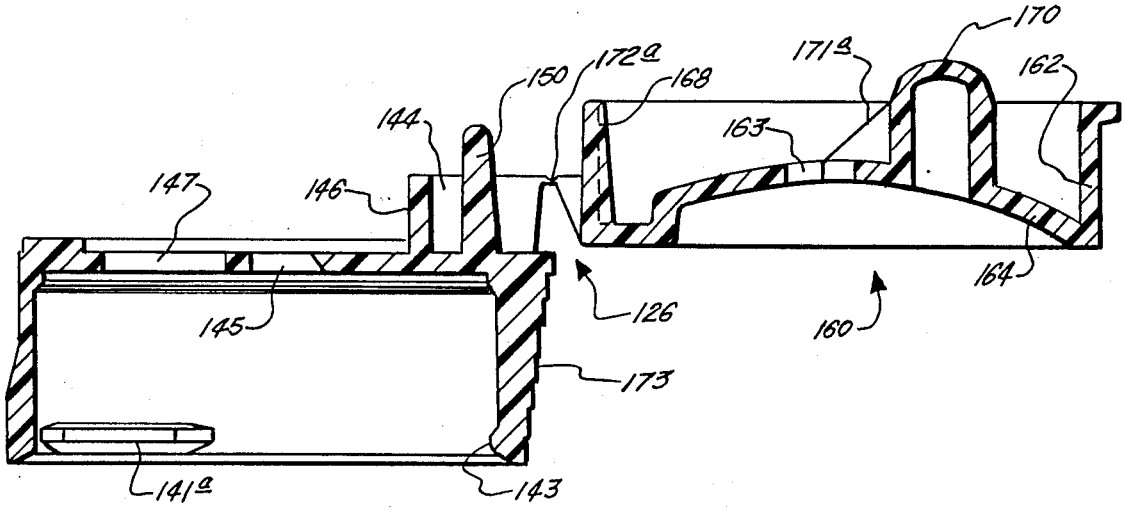
Figure 11:
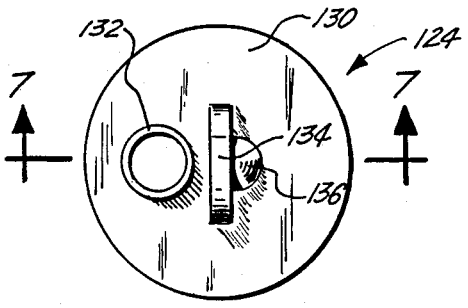
Figure 12:
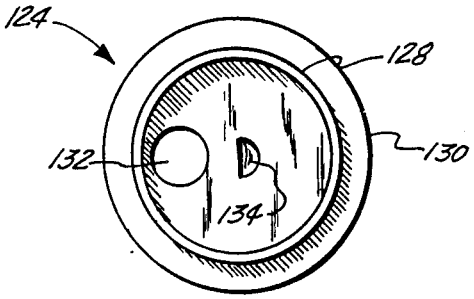
Figure 13:
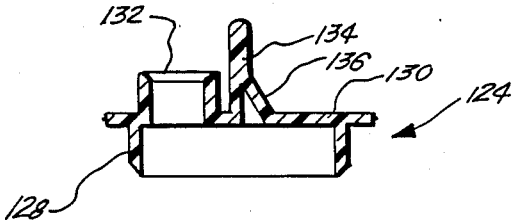
Figure 14:
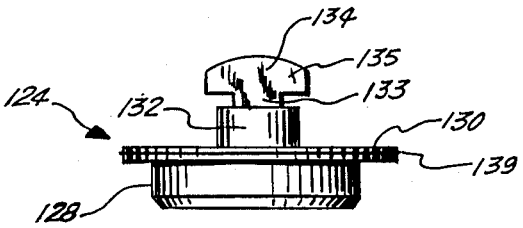
Figure 15:
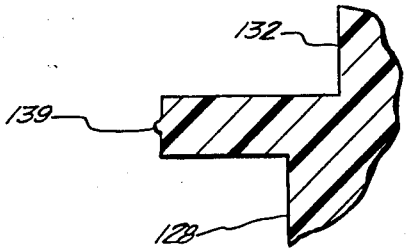
Figure 16:
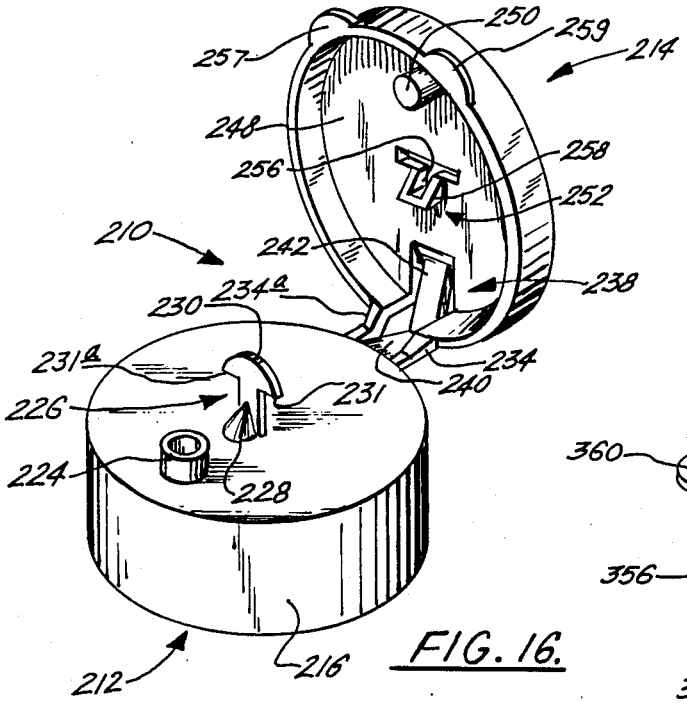
Figure 17:
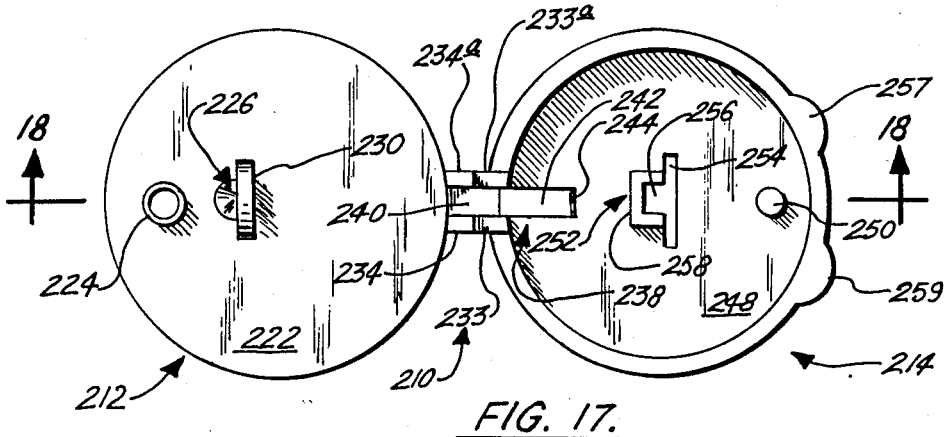
Figure 18:
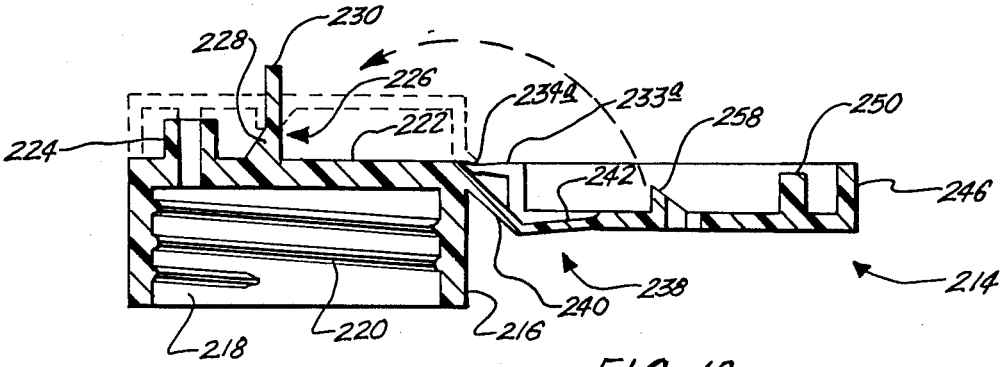

FIG. 8 is a bottom plan view of the cap and base piece component of the two-piece closure shown in FIG. 7;

FIG. 9 is a top plan view of the cap and base piece component of the two-piece closure shown in FIG. 7;

FIG. 10 is a sectional view taken through section lines 10—10 in FIG. 9;

FIG. 11 is a top plan view of the spout and post piece component of the two-piece closure shown in FIG. 7;

FIG. 12 is a bottom plan view of the spout and post piece component of the two-piece closure shown in FIG. 7;

FIG. 13 is a sectional view taken through section lines 7—7 in FIG. 11;

FIG. 14 is a front elevational view of the spout and post piece component of the two-piece closure shown in FIG. 7;

FIG. 15 is an enlarged detailed view showing the bead about the periphery of the plate which is part of the spout and post piece shown in FIG. 11;

FIG. 16 is a perspective view of a one-piece closure similar to that shown in FIG. 1, but having the locking aperture rotated by 180°;

FIG. 17 is a top plan view of the embodiment shown in FIG. 16;

FIG. 18 is a sectional view taken along section lines 18—18 in FIG. 17; and

Figure 19:
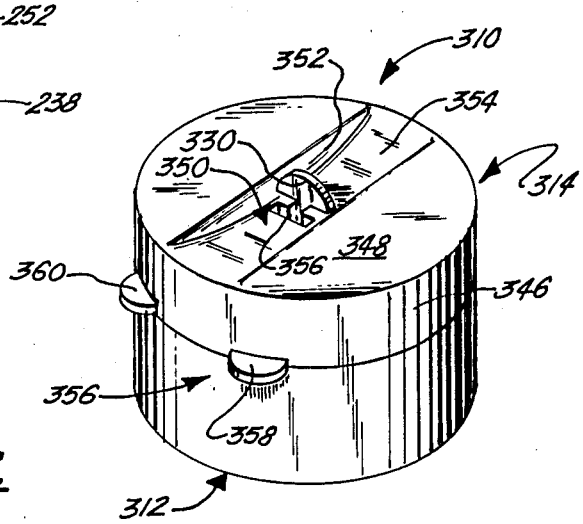

FIG. 19 is a perspective view of a one-piece closure similar to that of FIG. 1, but having a channel in the top cap wall for the post and locking aperture.

Referring now to FIGS. 1-5, there can be seen a one-piece closure, generally designated by the numeral 10 comprised of a base, generally designated by the numeral 12, and a cap, generally designated by the numeral 14. Cap 14 is hingedly connected to base 12 by way of hinges 33 and 33*a* which form a first hinge line 34. The embodiment shown in the drawings is typical of the type of closure which would be made of a thermoplastic material and produced by injection molding techniques.

Base 12 has an annular side wall 16 which carries about its inside surface 18 helical thread 20. Helical thread 20 is for cooperation with a helical thread about the neck of a container so as to affix closure 10 to the container. No structure is shown for closure 10 to prevent unthreading of closure 10 from a container, however, the use of such structure is within the scope of this invention and can be accomplished by adding such structure to inside wall 18 and to the neck finish of a container to which closure 10 is attached. Base side wall 16 has at one of its ends base top wall 22. Adjacent the periphery of base top wall 22 and substantially opposite hinges 33 and 33*a* is dispensing orifice 24. This location of dispensing orifice 24 is not critical to the functionality of closure 10, but is preferred. Integral with and upstanding from base top wall 22 is a post, generally designated by the numeral 26. Post 26 comprises strap portion 28 and enlarged upper end 30. Enlarged upper end 30 is configured to have an arcuate upper surface and two flat underside surfaces 31 and 31a. (See FIGS. 1 and 5). The configuration of enlarged upper end 30 may be different from that which is shown for the instant embodiment, the only requirement being that the configuration chosen be capable of accomplishing the functions hereinafter described for enlarged upper end 30. Strap portion 28 of post 26 is oriented so as to facilitate the resilient flexing of post 26 along a line which is transverse the long axis of underside surfaces 31 and 31*a*.

Cap 14 has an annular cap side wall 46 which is closed off at one of its ends by cap top wall 48. On the inside surface of cap top wall 48 is plug 50 which is in registry with and will plug dispensing orifice 24 when cap 14 is in the closed position. Cap top wall 48 has a locking aperture, generally designated by the numeral 52. Locking aperture 52 is T-shaped with a first, or crossing, portion 54 and a second, or crossed, portion 56. The length of first portion 54 is such that the length of enlarged upper end 30 is brought into alignment with first portion 54. Second portion 56 is dimensioned so as to accommodate within its confines strap portion 28 of post 26. However, second portion 56 is not of sufficient size to allow the passage of enlarged upper end 30 therethrough. As mentioned previously, enlarged upper end 30 may be of a different configuration than that which is shown for the instant embodiment and, in that case, locking aperture 52 will have to be configured so as to accommodate the particular shape chosen for enlarged upper end 30. For example enlarged upper end 30 could be a circular button and, in that case, first portion 54 would have to likewise be circular to allow for the passage therethrough of the circular button. Second portion 56 can remain the same if the configuration of strap 28 is not changed.

Figure 2:
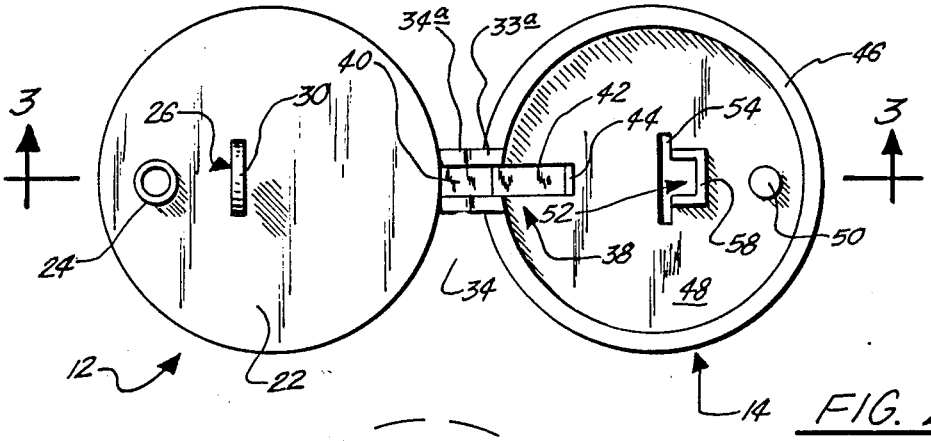
FIG. 2 is a top plan view of the embodiment shown in FIG. 1.
Figure 3:
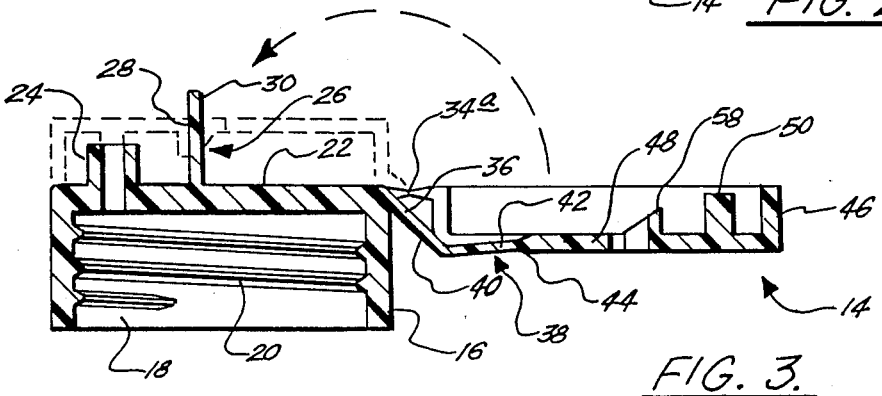
FIG. 3 is a sectional view taken along Section lines 3—3 in FIG. 2.
Figure 4:
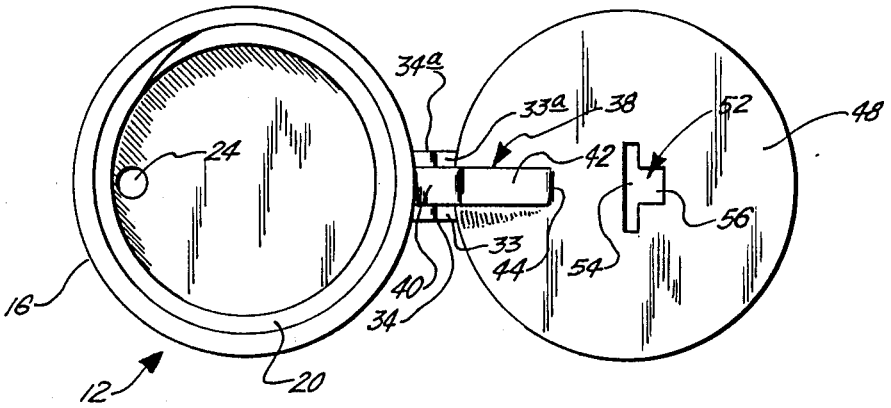
FIG. 4 is a bottom plan view of the closure shown in FIG. 1.
Figure 5:
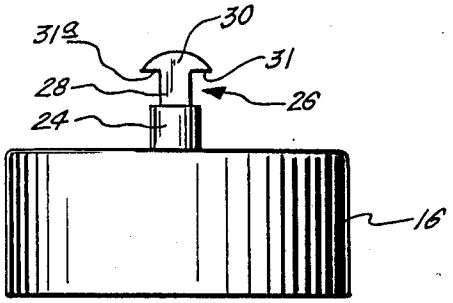
FIG. 5 is a front elevational view of the closure shown in FIG. 1.

Also on the inside of cap top wall 48 is ramp structure 58. Ramp structure 58 is located so as to contact enlarged upper end 30 and to deflect post 26 when cap 14 is brought to the closed position so that enlarged upper end 30 is in alignment with first portion 54 of locking aperture 52. The configuration of the enlarged upper end 30 has an additional function which is to serve as an alignment feature for the plug 50 as well as the locking aperture 52. In a preferred embodiment shown in FIGS. 1-5, the arcuate upper surface of enlarged upper end 30 is self-centering on locking aperture 52. Thus, the alignment of post 26 also assures the alignment of plug 50 with dispensing orifice 24. As can be seen in FIGS. 1-3, ramp structure 58 is comprised of two angular side walls and an upstanding connecting wall, which walls surround three of the sides of second portion 56 of locking aperture 52. Other configurations for ramp structure 58 can be used so long as they provide the necessary deflection and alignment of enlarged upper end 30. For example, the connecting wall can be eliminated, provided that the two angular walls have sufficient strength to not be distorted during closure of cap 14.

The closure shown in FIGS. 1-6*c* is provided with an overcenter hinge, which is generally designated by the numeral 38. Overcenter hinge 38 is hingedly connected to base portion 16 at hinge line 36 and is hingedly connected to cap 14 at hinge line 44. Overcenter hinge 38 has two legs, legs 40 and 42. The locations of hinge lines 36, 44 and 34 are such that overcenter hinge 38 acts to maintain cap 14 in either the open or closed position. Various overcenter hinges can be used, for example, see Re 30,861, U.S. Pat. Ser. No. 3,289,877, U.S. Pat. Ser. No. 4,414,705 and British Pat. Specification No.1,082,983. The use of an overcenter hinge is preferred but is not necessary for the operation of the closures of this invention.

Figure 6A:
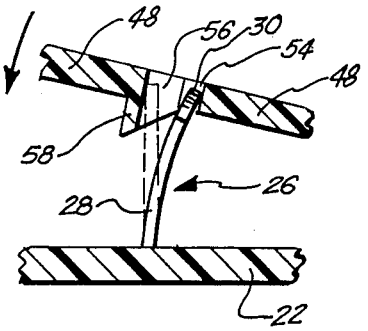
Figure 6B:
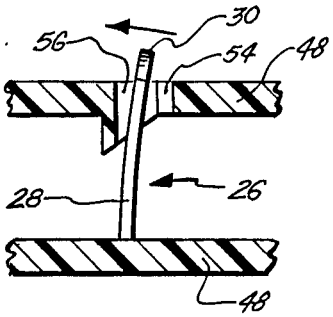
Figure 6C:
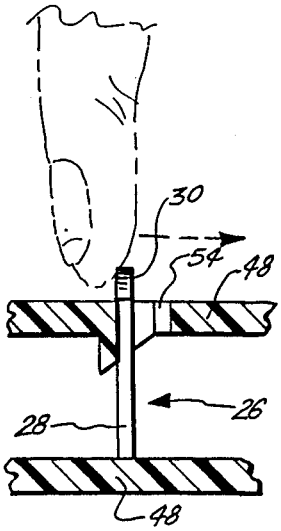

Illustrating the operation of the child-resistant feature of this invention, reference is made to FIGS. 6*a*-6*c*. In FIG. 6*a*, cap 14 is being shown as it is moved towards the closed position. As cap top wall 48 moves downward, ramp structure 58 contacts enlarged upper end 30 of post 26. Strap 28 is deflected until enlarged upper end 30 is in alignment with first portion 54 of locking aperture 52. In FIG. 6*a*, it can be seen that enlarged upper end 30 has entered first portion 54. FIG. 6*b* shows strap portion 28 moving into second portion 56 once enlarged upper end 30 has cleared the top surface of cap top wall 48. This movement is due to the resiliency of strap portion 28. In FIG. 6*c*, strap portion 28 has reached its original molded position and is no longer under tension. Enlarged upper end 30 is located within second portion 56 with its underside surfaces 31 and 31*a* overlying a portion of the top surface of cap top wall 48. In this position, an attempted opening of cap 14 is frustrated, since strap portion 28 is integrally formed or rigidly connected to base top wall 22 and underside surfaces 31 and 31*a* are overlying the before mentioned portions of cap top wall 48. To allow for opening of cap 14, the user merely exerts a force on enlarged upper end 30 so as to bring it in alignment with first portion 54 of locking aperture 52. In this position, cap 14 can be raised since there is no longer an interfering fit associated with enlarged upper end 30. Enlarged upper end 30 passes through first portion 54 and cap 14 can be raised or opened. Also, plug 50 is removed from dispensing orifice 24 and the contents of the container can be dispensed.

It is to be understood that while the embodiment shown in FIGS. 1–6*c* shows an orientation of locking aperture 52 which places second portion 56 closest to dispensing orifice 24, when cap 14 is closed, it is in keeping with the concept of this invention to use locking aperture 52 in other orientations. For example, locking aperture 52 can be oriented to be 180° from the orientation shown in the drawings. In this last orientation, deflection of post 26 is simply made along the same deflection line but in an opposite direction, as described below and shown in FIGS. 16–18.

Referring now to FIGS. 7–15, there can be seen a two-piece closure of this invention, which is generally designated by the numeral 122. In FIG. 7, closure 122 is shown fitted to a container, which is generally designated by the numeral 112. Container 112 has a neck portion 114 which terminates at the container mouth with an inwardly turned annular flange 120. Near the lower portion of neck 114 is annular rib 116 which, as can be seen in FIG. 7, has a gap 118 therein. Container 112 can be of thermoplastic material or glass, metal, etc., there being no criticality as to the material of construction.

Closure 122 is of two separate pieces, one being base and cap piece 126 and the other being post and spout piece 124. The base and cap piece 126 comprises a base portion 139 and a top portion 160. Base portion 139 has an annular sidewall 140 which has at one of its ends top wall 142. Top wall 142 has orifice 147 through which dispensing spout 132 will extend as hereinafter described. Top wall 142 also has another aperture 145 which will allow for passage of post 134 as can be seen in FIG. 7. Extending from top wall 142 and at a point opposite orifice 147 is lever 150. Surrounding lever 150 are walls 146, 144 and 148 which extend upwardly from top wall 142.

As is shown in FIGS. 7 and 10, base portion 139 has, on the inside surface of annular wall 140, lug 143 which is dimensioned to obtain an interference fit under annular bead 116 of container 112. Lug 143 is also dimensioned to be capable of non-interfering passage through gap 118 when lug 143 is brought in registry with gap 118. To also aid in fitment of closure 122 to container 112, the inside surface of base sidewall 140 also carries supplementary lugs 141*a* and 141*b*. As can be seen in FIG. 8, these supplementary lugs have a greater angular extent than that of lug 143. FIG. 7 shows in part the location of the interference obtained between lugs 141*a* and 141*b* with bead 116 when closure 122 is fitted to container 112.

Cap portion 160 of base and cap piece 126 is hingedly attached to base portion 139 by way of hinges 172*a* and 172*b* as is seen in FIGS. 7–10. Cap portion 160 has a top wall 164 which is at one end of annular cap sidewall 162. Top wall 164 carries plug 170 which is dimensioned to fit within spout 132 to obtain a liquid-tight seal when closure 122 is in the closed position. Top wall 164 also has locking aperture 163 which is T-shaped. Locking aperture 163 has a first portion, or a crossing portion, 165 and a second portion, or crossed portion, 167. The description for the closure shown in FIGS. 1–6 concerning locking aperture 52 is equally applicable to locking aperture 163 and will not be repeated.

On the inside surface of top wall 164 is ramp structure 171 which is identical to ramp structure 58 previously described for the closure of FIGS. 1–6. The configuration and function of ramp structure 171 is the same as that for ramp structure 58.

Comprising a part of annular cap sidewall 162 is sidewall portion 168. Sidewall portion 168 which cooperates with lever 150 to obtain for closure 122 an overcenter hinge action which will urge cap portion 160 either to the open or to the closed position, depending upon the position of cap portion 160 with respect to base portion 139. The co-action of lever 150 and sidewall portion 168 is shown in FIG. 7. For a more detailed description of this type of overcenter hinge, reference is made to U.S. Pat. Ser. No. 4,244,495 which, for the purposes of describing this type of overcenter hinge is incorporated herein as if fully set forth.

FIGS. 11–15 show spout and post piece 124. Spout and post piece 124 has a plate portion 130. Extending downwardly from plate portion 130 is annular wall 128. Extending upwardly from plate 130 is post 134. Post 134 has an enlarged end 135 and a strap portion 133. For the embodiment shown in FIGS. 11–15, post 134 is oriented so that it will be deflected in a direction away from spout 132. To aid in maintaining rigidity in strap portion 133 of post 134, there is provided brace 136. As is shown in FIG. 13, brace 136 extends from plate 130 to post 134 and is oriented in an angled relationship which is on the side of post 134 toward which post 134 will be deflected during the opening and closing of closure 122.

The assembly of cap and base piece 126 to spout and post piece 124 is easily achieved by inserting spout and post piece 124 into the interior of base portion 139 of cap and base piece 126. A snap-fit is achieved by way of annular bead 139, which is shown in FIGS. 14 and 15, and a groove located about the inside surface of base sidewall 140 at the point where the location of spout and post piece 124 is to be achieved. It is also to be understood that other snap-fits or welds can be used instead of or in conjunction with the snap-fit achieved by bead 139. A bead and groove snap-fit can be provided between the outside surface of spout 132 and the inside surface of orifice 147. The two just described snap-fits are not shown in FIG. 7 as their very small size makes their appearance too difficult to illustrate. As can be seen in FIG. 7, once spout and post piece 124 is nested against the inside surface of base top wall 142, spout 132 and post 134 extend through orifice 147 and post aperture 145 which are provided in top wall 142 of base portion 139 of cap and base piece 126.

The closure shown in FIGS. 7–15 is of the type which could be used without or in combination with a liner. As is shown in FIG. 7, liner 179 is captured between annular flange 120 and the inside surface of plate 130. To assist in the stable, liquid-tight mounting of closure 122 to container 112, the outside diameter of annular wall 128 creates an interference fit with the mouth of container 112. Thus, annular wall 128 serves to provide a plug.

The operation of closure 122 in regards to the opening and closing of cap portion 160 is substantially identical to that for the closure of FIGS. 1–6. When cap portion 160 is brought to the closed position, enlarged end 135 of post 134 engages ramp structure 171 causing post 134 to be deflected away from dispensing orifice 147 and spout 132. This deflection will bring enlarged end 134 into alignment with second portion 165 of locking aperture 163. With this alignment obtained, cap portion 160 can be brought all the way to the closed position so that plug 170 obtains a liquid-tight nesting within spout 132. To open closure 122 from the closed position, the user merely deflects post 134 towards hinges 172*a* and 172*b* so that enlarged end 135 is in alignment with second portion 165 of locking aperture 163. With this alignment achieved, cap 160 can be lifted and plug 170 unnested from spout 132.

To remove closure 122 from container 112, the user need only to bring lug 143 into registry with gap 118. This is easily achieved by gripping closure 122 and rotating it about container 122 until such registry is achieved. The user can conveniently apply a removal force by placing the thumb on surface 173 and pushing closure 122 so that lug 143 will move through gap 118 with lug 143 no longer in interference with bead 116. The interference between supplementary lugs 141*a* and 141*b* with bead 116 is easily defeated and closure 122 is removed from container 112. To refit closure 122 to container 112, the user need only snap the closure over bead 116, because the closure 122 is so designed that it will snap-fit onto container 112 in any position and does not have to be in any particular alignment. However, for better retention, the lug 143 of closure 122 should not be aligned with gap 118 in container 112.

Closure 122 can be made by conventional molding of thermoplastic materials. It is to be understood, however, that spout and post piece 124 and cap and base piece 126 need not be of the same material so long as the before described functions are permitted by the materials of choice. An added feature of closure 122 is that spout and post piece 124 can be manufactured to have a different color than that for cap and base piece 126, thereby clearly identifying post 134 as a part of the child-resistant structure of closure 122.

In another embodiment of the present invention shown in FIGS. 16–18, there can be seen a one-piece child-resistant closure which is generally designated as 210. Closure 210 has a base 212 and a cap 214. Cap 214 is hingedly connected to base 212 by way of hinges 233 and 233*a* which form a first hinge line 234.

Base 212 has an annular side wall 216 which carries about its inside surface 218 helical thread 220. Helical thread 220 is for cooperation with a helical thread about the neck of a container so as to affix closure 210 to the container. Although no structure is shown for closure 210 to prevent the unthreading of closure 210 from a container, the use of such an unthreading prevention structure is within the scope of this invention and can be accomplished by addition to inside wall 218 and to the neck finish of a container to which closure 210 is attached.

Base side wall 216 has at one of its ends base top wall 222. Adjacent the periphery of base top wall 222 and substantially opposite hinges 233 and 233*a* is dispensing orifice 224. The location of dispensing orifice 224 is not critical to the functionality of closure 210, but is preferred. Integral with and upstanding from base top wall 222 is post 226 which comprises strap portion 228 and enlarged upper end 230. Enlarged upper end 230 is configured to have an arcuate upper surface and two flat underside surfaces 231 and 231*a*, as shown in FIG. 16. Although the configuration of enlarged upper end 230 may be different from that which is shown for the instant embodiment, the only requirement as to structure is that the chosen configuration be capable of accomplishing the same functions described for upper end 30 of FIGS. 1–6 or post 134 of FIGS. 7–15. Strap portion 228 of post 226 is oriented so as to facilitate the resilient flexing of post 226 along a line transverse to the long axis of underside surfaces 231 and 231*a*.

Cap 214 has an annular cap side wall 246 which is closed off at one of its ends by cap top wall 248. On the inside surface of cap top wall is plug 250 which is in registry with and, upon closing the cap 214, will plug dispensing orifice 224. Cap top wall 248 has a locking aperture 252 which is T-shaped, but oriented with T rotated 180° from the locking aperture 52 of FIGS. 1–4 and locking aperture 163 of FIGS. 7–10. The locking aperture 252 of this preferred embodiment is otherwise identical in function to previously described preferred embodiments of this invention. Thus, locking aperture has a first, or crossing, portion 254 and a second or crossed, portion 256. The length of first portion 254 is such that the length of enlarged upper end 230 can easily pass therethrough when enlarged upper end 230 is brought into alignment with first portion 254. Second portion 256 is dimensioned so as to accommodate within its confines strap portion 228 of post 226. However, second portion is not of sufficient size to allow the passage of enlarged upper end 230 therethrough. As mentioned previously, enlarged upper end 230 may be of a different configuration than shown for the instant embodiment and, in that case, locking aperture 252 will have to be configured so as to accommodate the particular shape chosen for enlarged upper end 230. For example, enlarged upper end 230 could be a circular button and, in that case, first portion 254 would have to be likewise circular to allow for passage therethrough of the circular button, whereas second portion 256 can remain the same if the size and configuration of strap 228 is not changed.

Also on the inside of cap top wall 248 is ramp structure 258, which is likewise rotated 180° from the ramp structure 58 of FIGS. 1–4 and 171 of FIGS. 7–10. Ramp structure 258 is located so as to contact enlarged upper end 230 and to deflect post 226 when cap 214 is being closed so that enlarged upper end 230 is in alignment with first portion 254 of locking aperture 252. The configuration of the enlarged upper end 230 has an additional function which is to serve as an alignment feature for the plug 250 as well as the locking aperture 252. In a preferred embodiment shown in FIGS. 16–18, the arcuate upper surface of enlarged upper end 230 is self-centering on locking aperture 252. Thus the alignment of post 226 also assures the alignment of plug 250 with dispensing orifice 224. As can be seen in FIGS. 16–18, ramp structure 258 is comprised of two angular side walls and an upstanding connecting wall, which walls surround three of the sides of second portion 256 of locking aperture 252. Other configurations can be used as hereinabove suggested.

The locking mechanism of this preferred embodiment has the advantageous feature of requiring deflection of the post 226 away from the hinge instead of towards the hinge as indicated hereinabove and in FIGS. 1–4 and 7–10. This direction of deflection—towards the hinge—is the same direction as the cap opening movement. Thus, a locking mechanism which requires deflection of enlarged upper end 230 away from the hinge and in a direction opposite the cap opening movement is believed to be more difficult to master for a child, but only requires understanding by an adult and is not more difficult to open for elderly or infirm adults.

As shown in FIGS. 16 and 17, lift-up tabs 257 and 259 are spaced about cap 214 to aid in raising it from the base 212 once the post 226 has been deflected toward the wide section of locking aperture 256. Although two tabs are shown, one, or more than two, may be used, spaced equidistantly from the hinge 238. More preferably, two lift-up tabs 257 and 259 are provided at an angle about the circumference of cap 214 of 90°, 135° or 165° from the hinge 238. Further, although shown as semicircular configurations, the lift-up tabs 257 and 259 can have any convenient shape.

In a still further preferred embodiment of this invention a different cap top wall having a channel scooped out of it provides more difficulty for children to grasp, but would be workable without particular difficulty by adults, including the elderly and infirm. Referring to FIG. 19, there is seen a one-piece closure, generally designated as 310, which is comprised of a base 312 and a cap 314 connected by a hinge (not shown). This embodiment has the structure generally described for previous embodiments, except that cap 314 has an annular side wall 346 which is closed off at one of its ends by top cap wall 348. Top cap wall 348 has scooped channel 350 along one diameter of top cap wall 348. Channel 350 has side walls 352 and **352*a* (not shown) and floor 354 which slopes from the periphery of top cap wall 348 to the central portion of channel 350. Locking aperture 356 is located in channel 350 and is in all respects similar to those described for previous preferred embodiments in FIGS. 1–4, locking aperture 52; FIGS. 7–10, locking aperture 163; and FIGS. 16–18, locking aperture 252, respectively. It is preferred that the enlarged upper end 330 of post 326 (not shown) not extend above the height of top cap wall 348, but this is not necessary. In this particular preferred embodiment, the height of side wall 346 may be greater than in previously described embodiments in order to accommodate ramp structures (not shown) inside cap 314 and to allow for post 326 (not shown) to extend outwardly from floor 354, but not extend beyond top cap wall 348**.

A further feature of this embodiment is the provision about the circumference of the cap 314 of lift-up tabs 358 and 360. These protrusions aid in lifting the cap 314 off the base 312 when the enlarged end 330 is deflected to pass through locking aperture 356. Although two tabs are shown, only one or three or more may be used at any convenient point about the circumference of side wall 346. Preferably, two lift-up tabs as shown in FIG. 19 are spaced about the circumference of cap 314 equidistant from hinge (not shown) and preferably at angles of 90°, 135° or 165° about the circumference of cap 314 from the hinge (not shown). In like manner, the configuration of lift-up tabs need not be circular, but can be of any convenient shape.

Similarly with other embodiments of this invention the locking mechanism can be oriented to require deflection toward or away from the hinge or in any other direction about the 360° of the closure.

We claim:

1. A child-resistant dispensing closure for a container, said closure comprising:

(a) a base having, (i) an annular base side wall, (ii) a base top wall at one end of said annular base side wall, (iii) a dispensing orifice in said base top wall through which the contents of said container can be dispensed; and (iv) a resilient post extending upwardly from said base top wall and adapted to flex in a flexing direction, said post having an enlarged upper end enlarged in a direction lateral of said flexing direction; and a cap hingedly connected to said base, said cap being movable between an open position and a closed position and said cap having a cap top wall being formed with a locking aperture located within the periphery of said cap top wall, said aperture having a wider first portion and a narrower second portion, arranged side-by-side in said flexing direction, the enlarged upper end of said post being aligned with said wider first portion when the post is in a deflected position and being aligned with said narrower second portion when said post is in its predeflection position, said wider first portion being dimensioned to pass said enlarged upper end, said narrower second portion being dimensioned to receive a portion of the post underneath said enlarged upper end but not being ample enough to pass said enlarged upper end, thereby blocking the opening of the cap when said cap is in said closed position until the post is moved to the deflected position.

2. The child-resistant dispensing closure of claim 1 wherein said cap additionally has an annular side wall which depends from said cap top wall.

3. The child-resistant dispensing closure of claim 1 wherein said cap has plugging means for plugging said dispensing orifice when said cap is in said closed position.

4. The child-resistant dispensing closure of claim 3 wherein said plugging means is a solid, radiused plug which depends from said cap top wall so that when said cap is in said closed position said dispensing orifice is substantially sealed.

5. The child-resistant dispensing closure of claim 1 wherein said locking aperture is T-shaped with said first portion being the crossing portion and said second portion being the crossed portion of said T and said second portion having its crossed axis substantially along the path which said post travels between its deflected position and its predeflection position.

6. The child-resistant dispensing closure of claim 1 wherein said cap additionally has deflecting means for achieving the deflection of said post during the movement of said cap from said open position to said closed position.

7. The child-resistant dispensing closure of claim 6 wherein said enlarged upper end has a regular profile which is greater in height at the center and gradually decreases in regular shape towards the bottom so that upon contacting said deflecting means during the movement of said cap from said open position to said closed position said cap is aligned for proper closure

8. The child-resistant dispensing closure of claim 7 in which said enlarged upper end is arcuate in shape.

9. The child-resistant dispensing closure of claim 8 in which said post is a flat strap and said enlarged upper end attached thereto is a flat semi-circular enlarged upper end having its arcuate side upward.

10. The child-resistant dispensing closure of claim 1 wherein said closure is of thermoplastic material.

11. The child-resistant dispensing closure of claim 1 wherein said closure additionally has a brace member which extends at an angle from said post to said base top wall on the post side towards which said post is deflected.

12. The child-resistant dispensing closure of claim 1 wherein said closure is an integrally formed one-piece closure.

13. The child-resistant dispensing closure of claim 12 wherein said locking aperture is T-shaped with said first portion being the crossing portion and said second portion being the crossed portion of said T and said second portion having its crossed axis substantially along the path which said post travels between its deflected position and its predeflection position.

14. The child-resistant dispensing closure of claim 13 wherein said T-shaped locking aperture is oriented so that said first position is nearer said dispensing orifice than said second portion and said post is deflected toward said dispensing orifice during the movement of said cap from said open position to said closed position.

15. The child-resistant dispensing closure of claim 13 wherein said T-shaped locking aperture is oriented so that said second portion is nearer said dispensing orifice than said first portion and said post is deflected away from said dispensing orifice during the movement of said cap from said open position to said closed position.

16. The child-resistant dispensing closure of claim 13 wherein said cap additionally has deflecting means for achieving the deflection of said post during the movement of said cap from said open position to said closed position.

17. The child-resistant dispensing closure of claim 16 wherein said closure is of thermoplastic material.

18. The child-resistant dispensing closure of claim 17 wherein said closure additionally has a brace member which extends at an angle from said pot to said base top wall on the post side towards which said post is deflected.

19. The child-resistant dispensing closure of claim 1 wherein said closure is a two-piece closure with one of said pieces comprising said post, and wherein said base top wall has an aperture through which said post extends.

20. The child-resistant dispensing closure of claim 19 wherein said one of said pieces additionally has a plate which is nestable against the under surface of said base top wall and wherein said plate is integrally formed with said post.

21. The child-resistant dispensing closure of claim 20 wherein said one of said pieces additionally has a brace member which extends at an angle from said post to said plate on the port side towards which said port is deflected.

22. The child-resistant dispensing closure of claim 21 wherein said locking aperture is T-shaped with said first portion being the crossing portion and said second portion being the crossed portion of said T and said second portion having its crossed axis substantially along the path which said post travels between its deflected position and its predeflection position.

23. The child-resistant dispensing closure of claim 22 wherein said T-shaped locking aperture is oriented so that said first position is nearer said dispensing orifice than said second portion and said post is deflected toward said dispensing orifice during the movement of said cap from said open position to said closed position.

24. The child-resistant dispensing closure of claim 22 wherein said T-shaped locking aperture is oriented so that said second portion is nearer said dispensing orifice than said first portion and said post is deflected away from said dispensing orifice during the movement of said cap from said open position to said closed position.

25. The child-resistant dispensing closure of claim 22 wherein said cap additionally has deflecting means for achieving the deflection of said post during the movement of said cap from said open position to said closed position.

26. The child-resistant dispensing closure of claim 25 wherein said closure is of thermoplastic material.

27. The child-resistant dispensing closure of claim 26 wherein said closure additionally has a brace member which extends at an angle from said post to said base top wall on the post side towards which said post is deflected.

28. The child-resistant dispensing closure of claim 1 having attached to said cap a lift-up means positioned about the circumference of said cap at an angle of about 90° to about 180° from the hinged connection.

29. The child-resistant dispensing closure of claim 28 further characterized in that said lift-up means comprises at least two separate lift-up tabs each disposed on opposed sides of said cap and about the circumference of said cap at an angle of about 90° to about 165° from the hinged connection.

* * * * *